US005964012A

United States Patent [19]

Vigreux

[11] Patent Number: 5,964,012

[45] Date of Patent: Oct. 12, 1999

[54] HINGING FITTING FOR A DOOR, WINDOW OR THE LIKE

[75] Inventor: Daniel Vigreux, Sarrebourg, France

[73] Assignee: Ferco International Ferrures et Serrures de Bâtiment Société Anonyme, Sarrebourg, France

[21] Appl. No.: 08/843,676

[22] Filed: Apr. 10, 1997

[30] Foreign Application Priority Data

Apr. 19, 1996 [FR] France ..... 96.05126

[51] Int. Cl.[6] ..... E05D 7/04

[52] U.S. Cl. ..... 16/241; 16/224; 16/235

[58] Field of Search ..... 16/235, 239, 240, 16/242, 245, 241, 224; 49/192

[56] References Cited

U.S. PATENT DOCUMENTS

| | | | |
|---|---|---|---|
| 583,512 | 6/1897 | Sexton | 16/242 |
| 1,540,581 | 6/1925 | Way | 16/242 |
| 1,900,081 | 3/1933 | Swerer | 16/242 |
| 4,980,946 | 1/1991 | Versani et al. | 16/235 |

FOREIGN PATENT DOCUMENTS

| | | | |
|---|---|---|---|
| 0421126 | 4/1991 | European Pat. Off. | 16/235 |
| 3504921 | 8/1986 | Germany | 16/235 |
| 2227521 | 1/1990 | United Kingdom | 16/241 |
| 2264532 | 9/1993 | United Kingdom | 16/235 |
| 2276204 | 9/1994 | United Kingdom | 16/235 |

*Primary Examiner*—Chuck Y. Mah
*Assistant Examiner*—Donald M. Gurley
*Attorney, Agent, or Firm*—Harrison & Egbert

[57] ABSTRACT

A hanging fitting for a door, window or the like having a fixed support inserted on the sash-frame and on which is installed a spindle for inserting a movable support fixed on the leaf of the door, window or the like into a bushing. The spindle is pivotally installed, by an eccenter, on the fixed support. The bushing corresponding with the movable support is covering a sleeve. This sleeve has an eccentered bore for receiving the spindle of the fixed support.

8 Claims, 2 Drawing Sheets

HINGING FITTING FOR A DOOR, WINDOW OR THE LIKE

BACKGROUND OF THE INVENTION

1. Field of the Invention

The invention relates to a hinging fitting, namely a bent support for a door, window or the like.

This invention will find its application in the field of the building ironmongery and relates, in particular, to hinging fittings for a door, window or the like.

2. Description of the Prior Art

There are already known a number of hinging fittings which ensure the pivoting connection of a door, window and the like to a sash-frame. There are bent supports which accordingly ensure the lower connection to the sash-frame of a leaf pivoting the spindle, the tilting is in connection with this mounting, by means of a ball pin, of the spindle on its fixed support.

Very often, this kind of hinging fitting includes a number of adjusting means for adjusting the positioning of the leaf with respect to its sash-frame. Some of these adjusting means act in the plane of the door, window or the like and/or in a perpendicular direction. The function is to modify the force of compression of the leaf against the sash-frame when closing the door, window or the like.

Thus, it is known to carry out this adjustment of the compression by acting on the fixing means of the movable support integral with the leaf.

Furthermore, there are known various embodiments which allow the tilting of the leaf to the left or to the right in the plane of the sash-frame. These may act on the connection between the spindle and the fixed support of the sash-frame. It is obvious that this makes the construction of this fixed support more complex.

In addition, it should be noted that it can be difficult to simultaneously manipulate these various adjusting means since some act perpendicular to and other act parallel to the plane of the sash-frame.

Therefore, the installer must proceed by trial and error, successively on one side, then on the other side. This makes the operation particularly difficult and constraining.

There is also known a bent support for a swinging and tilting a leaf which includes a fixed support inserted on the sash-frame and on which a spindle is tiltingly installed. This spindle is defined either by a rod or by a screw on which is inserted a sleeve including an eccentered bore. This assembly is engaged into the bore of a bushing on a movable support inserted on the leaf. Through an action on the angular position of the sleeve, the position of the leaf with respect to the sash-frame of the door, window or the like changes.

In brief, one cannot merely adjust the force of compression of the leaf against the sash-frame without this also causing an offset of this leaf in the plane of this sash-frame. Obviously, it is true that by turning the spindle systematically by 180°, this may result into an action on the leaf in only one of the directions parallel or perpendicular to the plane of the sash-frame. This means however that the device provides only two adjusting positions and that no fine adjustment of this position of the leaf with respect to the sash-frame can be achieved.

There is also known a bent support for swinging and tilting-type leaves. This bent support includes a fixed support provided with a ball pin on which is pivotingly installed a spindle which is eccentered with respect to the axis of the ball pin. On this spindle is inserted a bushing corresponding to a movable support inserted on the leaf. Accordingly, by ensuring the rotation of the spindle on its ball pin, the position of the leaf with respect to the sash-frame changes in a direction parallel and perpendicular to the plane of the sash-frame. The fixed support can be installed on the sash-frame in an adjustable way, in particular in a direction parallel to the plane the sash-frame. Thus, under such circumstances, one may, on the one hand, act on the angular position of the spindle in order to change the force of compression of the leaf against the sash-frame and, on the other hand, move the fixed support in order to carry out an adjustment in the plane of this sash-frame. Such a solution is obviously particularly complex.

SUMMARY OF THE INVENTION

The present invention facilitates this adjustment of the positioning of a leaf with respect to its sash-frame by manipulating the compression in a direction parallel to the plane of the door, window or the like or even simultaneously in both directions, while making the design of the bent support simplier.

The invention is a hinging fitting for a door, window or the like, having a fixed support inserted on the sash-frame and on which is installed a spindle inserted into a bushing of a movable support fixed on the leaf of said door, window or the like. The spindle is pivotally installed, by means of an eccenter, on the fixed support. The bushing corresponding to the movable support is covered with a sleeve having an eccentered bore for receiving the spindle of the fixed support.

The advantages resulting from this invention mainly consist in that the bent support, while providing the user with the ability to adjust the wing both in compression and in the plane of the sash-frame. This ability results from a simplified design. In addition, the user may, should the case arise, simultaneously the gripping means of the bushing and those of the spindle with two different tools. Advantageously, the invention provides an easy, quick and continuous adjustment of the leaf with respect to the sash-frame.

The invention will be better understood when reading the following description with reference to the attached drawings corresponding to exemplary embodiments.

DESCRIPTION OF THE PREFERRED EMBODIMENTS

Figure 4:
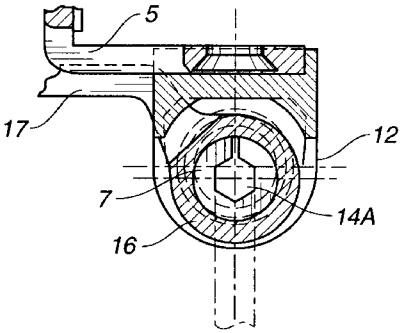
FIG. 4 is a view similar to FIG. 3, in the case in which the leaf is in a middle position with respect to the adjustments shown in FIG. 3 and in FIG. 5, but also in a position separated to the maximum from the sash-frame.
Figure 5:
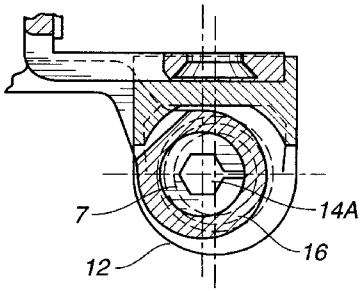
FIG. 5 is a view similar to FIG. 3, in the case in which the leaf is, under the action of the rotation of the eccentered spindle, pushed back to the maximum in an opposite direction with respect to the hinging fitting.
Figure 2:
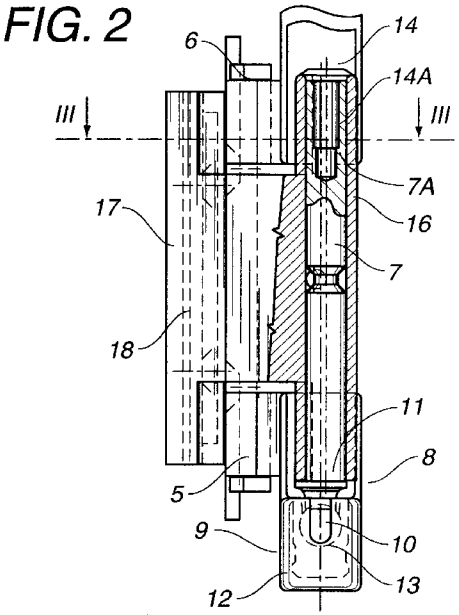
FIG. 2 is a schematical and cross-sectional partial view of a hinging fitting simply including an eccentered spindle.
Figure 3:
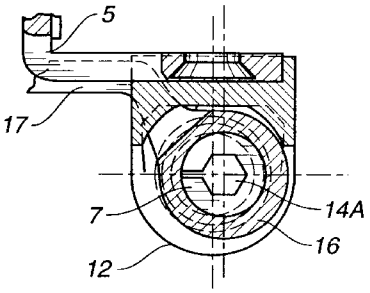
FIG. 3 is a schematical and cross-sectional view along III—III of FIG. 2, corresponding to the case in which the spindle is so turned as to offset the leaf to the maximum in the direction of the hinging fitting in the plane of the sash-frame.
Figure 1:
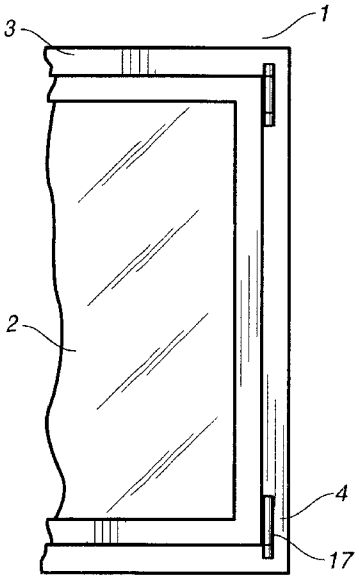
FIG. 1 is schematical and partial view of a window provided with a hinging fitting according to the intention.

There has been shown, in FIG. 1, a window 1, which could also be a door, a French window or the like, the leaf of which is pivotally mounted on a sash-frame 3.

This invention relates to the bent support of such a window 1 which causes the hinged lower connection of the leaf 2 to pivot about a vertical axis on the sash-frame.

The hinging fitting 4, shown in FIGS. 2 to 11, includes a fixed support 5 which is provided with a fixing means 6 for ensuring its connection to the sash-frame 3. A spindle 7 is integral to the fixed supports and forms the axis of pivoting of the leaf 2 with respect to the sash-frame 3.

This spindle 7 is pivotingly mounted, by means of an eccenter 8, on this fixed support 5. The connection between this spindle 7 and this fixed support 5 is achieved through a hinging means 9 in the shape of a ball pin. This ball pin allows the tilting of the leaf 2 with respect to the sash-frame 3 about an axis perpendicular to the spindle 7.

Such hinging means 9 is defined by a spherical head provided at the lower end 11 of the spindle 7 and inserted into a ball-pin cage 12 integral with the fixed support 5 and having a semispherical recess 13.

It should be noticed that the eccenter 8 is actually defined by this hinging means 9, in particular by the spherical head which is eccentered with respect to the spindle 7.

In addition, according to the invention, the spindle 7 includes gripping means 14. The gripping means 14 gives the ability to adjust the position of the leaf 2 with respect to the sash-frame 3 in a direction perpendicular and/or parallel the sash-frame 3.

As shown in FIGS. 2 to 5, these gripping means 14 may be in the shape of a slot for receiving a screwdriver or in the shape of a hexagonal hole 14A for receiving a spanner. The gripping means 14 is located at the free end 7A of the spindle 7.

According to another embodiment which can be seen in FIGS. 6 to 11, these gripping means 14 may be in the shape of a crown 14B topping the spherical head 10. The crown 14B can be grasped by a tool, such as a spanner, so as to control the pivoting of the spindle 7 about an eccentered axis 1 passing through the center of the spherical head.

This spindle 7 is inserted into a bushing 16 with which is provided a movable support 17 which forms the hinging fitting 4. The movable support is attached on the leaf 2 through fixing means 18. By manipulating the gripping means 14 to cause the eccentered spindle 7 to pivot, the pressure with which the leaf 2 is applied against the sash-frame 3 when closing the window 1 progressively and continuously changes. The position of the leaf 2 with respect to this sash-frame 3 is correspondingly adjusted in a direction parallel to the plane of this latter.

In this respect, it is advantageous to be able to move the leaf 2 in either direction parallel or perpendicular to the plane of the sash-frame 3.

For this purpose and according to the invention, there is advantageously provided a sleeve 20 which is internally received by the bushing 16. The sleeve 20 has a bore 21 with an eccentered axis 22 for receiving the spindle 7 of the fixed support 5. Thus, the bore 21 has a diameter 23 which fits the cross-section of this spindle 7.

The sleeve is also provided with a gripping means 24. The gripping means 24 gives the user the ability to rotate the sleeve so as to change the position of the leaf 2 with respect to the sash-frame 3, in a direction both perpendicular and parallel to the plane of the sash-frame 3.

Thus, by causing the sleeve to pivot, one can compensate for the action and/or actions the pivoting of the spindle 7 generates for the leaf 2. An unwanted movement of the leaf 2 in the plane of the sash-frame 3 can thus be compensated for by rotating the spindle 7. This will change the pressure with which this leaf 2 applies against the sash-frame 3 when the window or door is closed.

Figure 11:
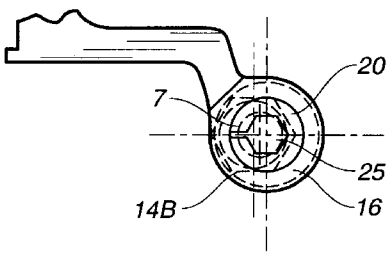
Figure 9:
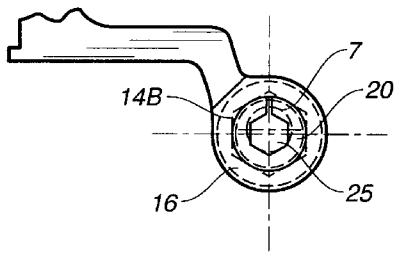
Figure 7:
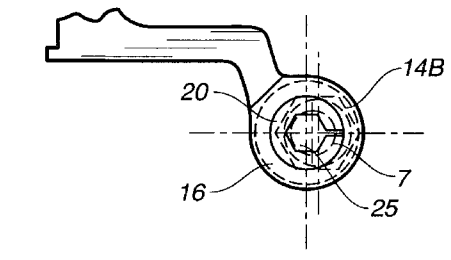
FIG. 7 is a plan view of this hinging fitting shown in FIG. 6 and corresponding to the case in which the action of the sleeve and the spindle offset the leaf to the maximum to the left in the plane of the sash-frame.

Furthermore, as can be seen in FIGS. 7, 9 and 11, the rotation of the sleeve compensates for the action resulting from the pivoting of the spindle 7. It can also amplify same, in a direction either parallel to the plane of the sash-frame 2 or perpendicular to same.

Of course, the amplitude of the possible adjustments depends on the eccentered position of the spindle 7 with respect to the spherical head and on the position of the bore 21 in the sleeve 20 with respect to the axis of the bore of the bushing 16.

The gripping means 24 can also be in the shape of a crown defined at one end of the sleeve located outside the bushing 16. The user is able to rotate this crown by means of an adequate tool, such as an adjustable spanner.

Thus, by way of an example, when the spindle 7 is itself provided with a crown 14B as gripping means 14, the crown corresponding to the sleeve may be provided for at the end 26 of the sleeve 20 and oriented towards the hinging means 9, so that it may superpose itself to the crown 14B of the spindle 7.

Finally, in the particular case in which the spindle 7 is mounted, at only its one end, on the fixed support 5, e.g. through hinging means such as a ball pin, the bore 21 can be in the shape of a blind hole provided for in the end 26 of the sleeve 20. The spindle can have gripping means 24 in its opposite end 26A in the shape of either a slot for receiving a screw-driver or a hexagonal hole 2 into which can be inserted an adequate spanner to control the rotation of this sleeve. The gripping means 14 corresponding to the spindle 7 are preferably defined by a crown 14B, as can actually be seen in FIGS. 6 to 11.

The installer can simultaneously grasp, by means of two adequate tools, the spindle 7 and the sleeve 20 so as to adjust, in a single operation, the position of the leaf 2 with respect to the sash-frame 3 in all directions.

Although the sleeve may be of any material the selection of this material may take into consideration particular characteristics, such as the friction coefficient of this sleeve 20 in the bore of the bushing 16 corresponding to the movable support 17. There should be provided a means for immobilizing the rotation of the sleeve 20 inside the bushing 16 or for allowing a free rotation between them, while immobilizing with means 27 the sleeve on the spindle 7.

Figure 10:
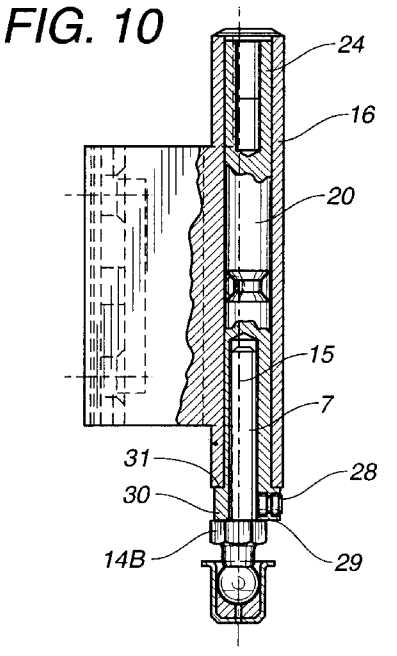
FIGS. 10 and 11, are views similar to the above-mentioned FIGS. 6 and 7, showing a reversed situation, i.e. when the leaf is offset, under the conjugated action of the sleeve and the spindle, to the maximum to the right with respect to the sash-frame.
Figure 8:
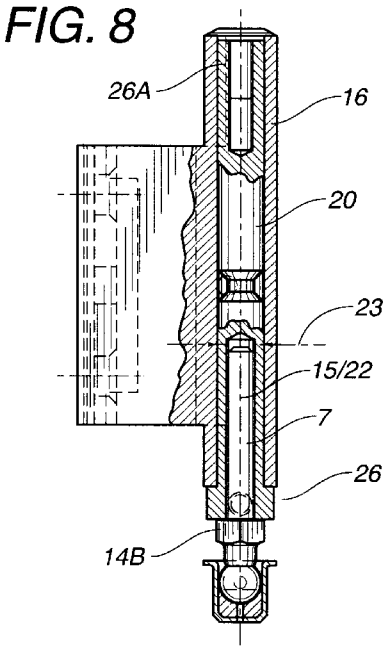
FIGS. 8 and 9 are views similar to the foregoing FIGS. 6 and 7, showing the components in an intermediate position with respect to the arrangements shown in FIGS. 6, 7, and 11.
Figure 6:
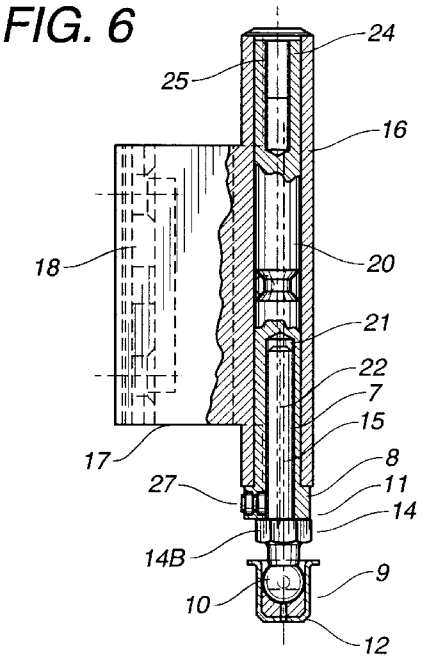
FIG. 6 is a schematical and cross-sectional partial view of a hinging fitting according to the invention simultaneously including an eccentered spindle and a bushing provided with an eccentered bore.

This latter solution is shown in FIGS. 6, 8 and 10.

The immobilization means 27 are in the shape of a clamping organ 28, such as a screw, passing through a tapped hole 29 provided for in the wall of the sleeve 20, so as to co-operate with the spindle 7 inserted in the bore 21 of this sleeve. According to a preferred embodiment, it includes, at its end 26 through which is inserted this spindle 7, an annular rim 30 defining a shoulder 31 resting on the end edge of the bushing 16. In this rim is provided the tapped hole 29 for receiving the clamping organ 28, so that this clamping organ 28 is, at any time, accessible for the installer to proceed the desired adjustment.

From the preceding description it can be seen that this invention advantageously solves the problems associated with the prior art. The present invention is an improvement since it provides a simplified design of the hinging fitting 4 while facilitating the adjustment of the leaf 2 with respect to the sash-frame 3.

What is claimed:

1. A hinging fitting for connecting a leaf to a sash-frame, the hinging fitting comprising:

a fixed support attachable to the sash-frame, said fixed support rotatably supporting a spindle at one end thereof, said spindle inserted into a bushing, said spindle having one end pivotally supported by an eccenter on said fixed support;

a movable support attachable onto the leaf, said bushing being attached to the movable support, said bushing having a bore which internally receives said spindle; and a sleeve received in said bore of said bushing, said sleeve having an eccentered bore along at least a part of a length of said sleeve, said eccentered bore of said sleeve rotatably receiving said spindle therein.

2. The hinging fitting according to claim 1, said spindle having a gripping means formed thereon, said gripping means for enabling said spindle and the eccentered bore to be rotated to a desired position.

3. The hinging fitting according to claim 2, said gripping means being a crown formed on said spindle which allows grasping by a tool.

4. The hinging fitting according to claim 1, said sleeve having gripping means formed thereon, said gripping means for allowing a rotation of the sleeve by a tool.

5. The hinging fitting according to claim 4, further comprising means for immobilizing rotation of said sleeve inside said bushing, said means for immobilizing attached to said bushing.

6. The hinging fitting according to claim 5, said sleeve having a wall in which is formed a tapped hole, said tapped hole receiving a clamping organ therein, said clamping organ being cooperative with said spindle inserted in said bore, said clamping organ forming the means for immobilizing.

7. The hinging fitting according to claim 6, said sleeve having an end through which said spindle is received within said bore, said bushing having an end edge on which rests a shoulder defined by an annular rim provided at said end of said sleeve, said rim having a tapped hole formed therein, said tapped hole receiving the clamping organ therein.

8. The hinging fitting according to claim 4, further comprising means for immobilizing rotation of said sleeve on said spindle, said means for immobilizing attached to said spindle.

* * * * *